US009125477B2

(12) United States Patent
Killion

(10) Patent No.: US 9,125,477 B2
(45) Date of Patent: Sep. 8, 2015

(54) BACKPACK HOOD STRAP

(76) Inventor: Bernard J. Killion, Louisville, KY (US)

( * ) Notice: Subject to any disclaimer, the term of this patent is extended or adjusted under 35 U.S.C. 154(b) by 454 days.

(21) Appl. No.: 13/134,593

(22) Filed: Jun. 13, 2011

(65) Prior Publication Data

US 2012/0312850 A1 Dec. 13, 2012

(51) Int. Cl.

| | |
|---|---|
| ***A45F 3/04*** | (2006.01) |
| ***A45F 4/12*** | (2006.01) |
| *A45F 3/00* | (2006.01) |
| *A41D 15/04* | (2006.01) |

(52) U.S. Cl.

CPC ... *A45F 3/04* (2013.01); *A45F 4/12* (2013.01); *A41D 15/04* (2013.01); *A45F 2003/003* (2013.01)

(58) Field of Classification Search

CPC ..... A45F 4/12; A45F 2003/003; A41D 15/04
USPC ..... 224/576, 647, 153, 577, 645; 150/109
See application file for complete search history.

(56) References Cited

U.S. PATENT DOCUMENTS

| | | | | | |
|---|---|---|---|---|---|
| 2,129,454 | A | * | 9/1938 | Wilkie | 2/84 |
| 2,136,380 | A | * | 11/1938 | Garrison | 2/84 |
| 2,136,393 | A | * | 11/1938 | Nelson | 2/84 |
| 3,929,143 | A | * | 12/1975 | Coleman | 2/171.2 |
| 4,389,735 | A | | 6/1983 | McLaughlin | |
| 4,563,777 | A | | 1/1986 | Park | |
| 5,165,111 | A | | 11/1992 | Lieberman | |
| D339,912 | S | * | 10/1993 | Delauter | D3/217 |
| 5,407,112 | A | | 4/1995 | Christodoulou et al. | |
| 5,676,293 | A | | 10/1997 | Farris | |
| 5,743,448 | A | | 4/1998 | Tsai | |
| 6,134,712 | A | | 10/2000 | Spector | |
| 6,843,398 | B2 | * | 1/2005 | Zion | 224/576 |
| 6,886,726 | B1 | * | 5/2005 | O'Hare | 224/576 |
| 7,363,659 | B1 | | 4/2008 | Colbert | |
| D619,802 | S | * | 7/2010 | Hedaya | D3/216 |
| 2003/0062391 | A1 | * | 4/2003 | Mitchell | 224/576 |
| 2003/0205593 | A1 | | 11/2003 | Lavelle | |
| 2005/0056669 | A1 | | 3/2005 | Lavelle | |
| 2006/0130220 | A1 | * | 6/2006 | Morgan et al. | 2/456 |
| 2007/0045369 | A1 | * | 3/2007 | Chen | 224/576 |
| 2009/0272773 | A1 | | 11/2009 | Andrade | |
| 2009/0283564 | A1 | | 11/2009 | Bass | |
| 2010/0078457 | A1 | | 4/2010 | Pitchford et al. | |

* cited by examiner

*Primary Examiner* — J. Gregory Pickett
*Assistant Examiner* — John Cogill
(74) *Attorney, Agent, or Firm* — Carrithers Law Office PLLC

(57) ABSTRACT

A backpack for carrying school supplies, camping equipment, tools or the like, including a plurality of pockets or compartments for various items and particularly including a longitudinal compartment within each back strap for storing one half of a longitudinally split hood. When inclement weather strikes, the user opens the compartment within each back strap, pulls out each half of the attached hood and joins the two hood halves together via a connecting means such as a zipper. The user then recloses the back strap compartments and puts the backpack on using the shoulder straps whereby the hood extends from the top portion of the backpack. The hood includes ties for fastening the hood around the user's head and under the chin.

3 Claims, 2 Drawing Sheets

BACKPACK HOOD STRAP

TECHNICAL FIELD

The present invention relates to backpacks and in particular to backpacks which include an integral attached hood which may be stored within a pocket or storage compartment of shoulder straps as an integral part of the backpack.

BACKGROUND OF THE INVENTION

Backpacks provide a convenient resource for carrying heavy or cumbersome loads and have been used in one form or another for centuries. Users have commonly used backpacks to carry camping gear. Backpacks are conventional means for carrying school supplies by children and students and provide a way for school materials to be safely carried on their backs, leaving their hands free for other activities. Individuals can be involved in activities such as hiking or school related activities while wearing a backpack leaving their hands free and transferring the bulk of the load and weight to be supported by ones shoulders instead of the arms. College students and faculty as well make use of backpacks. A benefit of being able to participate in activities while wearing a backpack is that the children are able to closely monitor their belongings at all times. Thus, the likelihood that their belongings will be lost or stolen is greatly reduced. The backpack also provides an easy method of organizing and keeping up with all of the a user's belongings.

Whenever and for whatever purpose a backpack is used, a covering for the user's head is a desirable item or even a requirement for the user when foul weather catches the user outdoors. A hood stored away in the backpack provides a simple solution to the problem. Some backpacks provide a hood which folds or rolls up and is stored in a compartment within the backpack. This method of storage uses space in the areas normally used to store other items. Further, if the hood is stored within the backpack compartment randomly with other items, getting the hood out and ready for use is delayed due to the fact that the hood is packed in among other items.

DESCRIPTION OF THE RELATED ART

Several patents provide storage within a particular pocket or compartment within the backpack but none has been seen which includes a compartment within the back straps suitable for storing a hood.

US Patent Publication No. 20100078457 by Pitchfork et al. for 'MULTI-FUNCTION BACKPACK-VEST DEVICE' which published on Nov. 5, 2009 teaches a backpack including pouch or compartment closed by a zipper or hook and loop fastener which contains a hood. The compartment is located at the top side of the backpack. Also included are small pockets on the back straps for carrying earphones or speaker wires which are connected to small speakers within the hood and which may be used with a small radio, MP3 player or the like. Pitchfork does not provide more efficient storage for the hood within the back straps as is provided for in the present application.

Other publications which teach methods of combining a hood with a backpack include: U.S. Pat. No. 4,389,735 by McLaughlin for 'CONVERTIBLE ARTICLE' which issued on Jun. 28, 1983; U.S. Pat. No. 4,563,777 by Park for 'COMBINATION CARGO PACK' which issued on Jan. 14, 1986; U.S. Pat. No. 5,165,111 by Lieberman for 'BACKPACK WITH INTEGRAL GARMENT' which issued on Nov. 24, 1992; U.S. Pat. No. 5,407,112 by Christodoulou et al. for 'CONVERTIBLE BACKPACK' which issued on Apr. 18, 1995; and U.S. Pat. No. 5,676,293 by Farris for 'BACKPACK AND METHOD OF USING SAME' which issued on Oct. 14, 1997. None of these provides for efficient storage of the hood within the back straps as is provided for in the present application utilizing a longitudinally split hood having a mating portion disposed in adjacent backpack straps as described by the instant invention.

SUMMARY OF THE INVENTION

In accordance with the present invention, a backpack is provided for carrying school supplies, camping equipment, tools or the like, including a plurality of compartments for various items and particularly including a longitudinal compartment formed within each backpack strap for storing a portion consisting of one half of a mating portion of a longitudinally split hood. Each longitudinal backpack strap includes a resealable means for opening and closing a longitudinal opening or slit formed in the back surface of the strap adjacent the user which forms a compartment whereby an distal end of each end of each hood portion is integrally attached to the top of the backpack at a selected position between the top attachment points of the backpack straps. When inclement weather strikes, the user opens the compartment within each back strap, pulls out each half of the attached hood and joins the two hood halves together via a connecting means such as a zipper. The user then recloses the back strap compartments and puts the backpack on using the shoulder straps whereby the hood extends from the top portion of the backpack. The hood includes ties for fastening the hood around the user's head and under the chin.

The backpack of the present invention comprises a backpack body comprising a front side and a back side connecting to a right side and a left side connecting to a bottom panel, and a top panel including an opening therein connecting to the front side, the back side, the right side and side left side, and a left backpack strap and a right backpack strap extending from the back side of the back pack. The left back strap comprising a longitudinal strip of tubular material defining hollow strap having a front side and a back side adjacent a user. The left back strap and the right back strap each one containing a longitudinal storage pocket disposed within the back side of the left back pack strap and the right backpack strap, the longitudinal storage pocket extending from the upper end of the strap a selected distance downward therefrom, each one of the pockets including a means for closure extending along the length of each of the longitudinal storage pocket. The left backpack strap and the right backpack strap having an upper free end attaching to an upper marginal edge of the backpack and a lower free end y attaching to a lower edge of the backpack. A split hood comprising a left hood portion and a right hood portion releasably joined together by a means for closing extending from a front end to a rear end of the split hood, the split hood having a proximal bottom end attaching to an upper end of the back side of the backpack. Wherein disengaging the left hood portion from the right hood portion of the split hood forms a pair of disconnected split hood portions, each one disposable in the corresponding longitudinal pocket of said backpack strap for storage.

More particularly, a preferred embodiment of the backpack includes a hood which is stored within compartments contained in the back straps of the backpack. The backpack is conventional and has a front side, a back side, a right side, a left side, a top, a bottom, a left back strap, a right back strap and a hood, the backpack including a plurality of storage compartments including closures. The left back strap has the upper free end rigidly attached at a position just to the left of the center of an upper marginal edge of a front side of the backpack. The right back strap has the upper free end thereof rigidly attached at a position just to the right of the center of an upper marginal edge of a front side of the backpack. The left back strap has a lower free end thereof rigidly attached to a lower left marginal edge of a front side of the backpack, and the right back strap has a lower free end thereof rigidly attached to a lower right marginal edge of a front side of the backpack. The hood comprises a left hood half, a right hood half and a hood zipper joining the halves. The left hood half has a right marginal edge and a top marginal edge thereof sown to a left side of the hood zipper. The right hood half has a left marginal edge and a top marginal edge thereof sown to a right side of the hood zipper, a lower marginal edge of the hood zipper being rigidly attached to the center of the upper marginal edge of the front side of the backpack and adjacent to the upper ends of the back straps. The zipper is capable of holding the left hoof half and the right hood half together to form a hood configured to be worn on a user's head. The left back strap and the right back strap each contain a longitudinal compartment or longitudinal pocket extending from the upper ends, down along most of the length thereof. The longitudinal pockets each includes a closing means such as a zipper extending along the length of each pocket thereof. The pockets each are capable of containing the free portion for covering the head of one of the hood halves therein when the hood zipper is unzipped, thus allowing the t hood half to be tucked into the longitudinal pocket within the back strap and allowing the opposing hood half to be tucked into the pocket within the adjacent opposing back strap, whereupon each pocket within each back strap pocket is zipped closed.

The backpack of the present invention provides hood storage within pockets in the back straps. Rather than providing a separate compartment within and near the top of the backpack, which takes up needed storage space, a hood is stored in compartments which are an integral part of the back straps. The hood is attached near the top of the backpack and near the top attachment point for the back straps. Further, the hood comprises two halves which are joined for use by a zipper. Another embodiment includes a one piece hood which is removably attached to the backpack. Besides providing space saving storage in the back straps, this approach provides much easier access to the hood when an immediate need arises, such as a cloudburst, because the back straps are exterior to the normal storage areas of the backpack and are close at hand.

The backpack of the present invention includes a plurality of compartments commonly provided by most backpacks which are held closed with a closure such as a zipper, hook and loop fasteners or ties. Also included are space saving compartments along the length of or integral with the back straps which are intended to store the two halves of a hood which can be removed from the compartments and zipped together to form a single hood.

Another embodiment of the backpack contains a one piece hood which is stored within a compartment in one of the back straps, leaving the compartment in the other back strap for storing other items.

It is an object of this invention to provide a backpack including a hood which is comprised of two halves held together by a zipper and wherein the zipper and the two halves of the hood are permanently fastened to the top side of a backpack near the points where the upper ends of the back straps are attached to the backpack.

It is another object of this invention to provide a backpack including a hood which is comprised of two halves held together by a zipper and which is removably fastened to the top side of a backpack near the points where the upper ends of the back straps are attached to the backpack.

It is another object of this invention to provide a backpack including two space saving storage compartments, each within or integral with a back strap on the backpack for storing each of the two halves of the hood when the hood is not joined into one unit by having the zipper closed.

It is an object of this invention to provide an alternative backpack including a one piece hood which can be stored within a space saving compartment within or integral with a back strap on the backpack.

It is an object of the present invention to provide a hood which can be lined and/or insulated from heat or cold.

It is an object of the present invention to provide a hood which can composed of a light weight material to server as a wind breaker.

It is an object of the present invention to provide a hood which can be composed of a mesh or light weave to serve as protection from the sun and permit optimal ventilation.

It is an object of the present invention to provide a hood which can be moisture resistant or moisture repellant.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
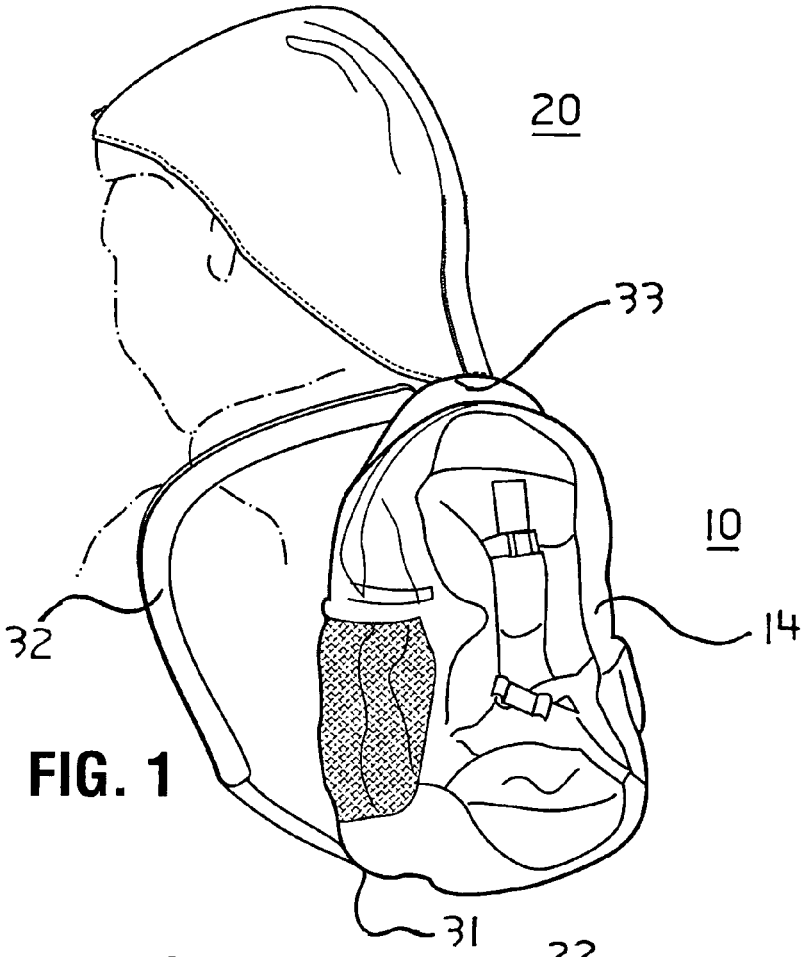
FIG. 1 is a perspective side view of the backpack with the hood assembled and being worn by a user.
Figure 3:
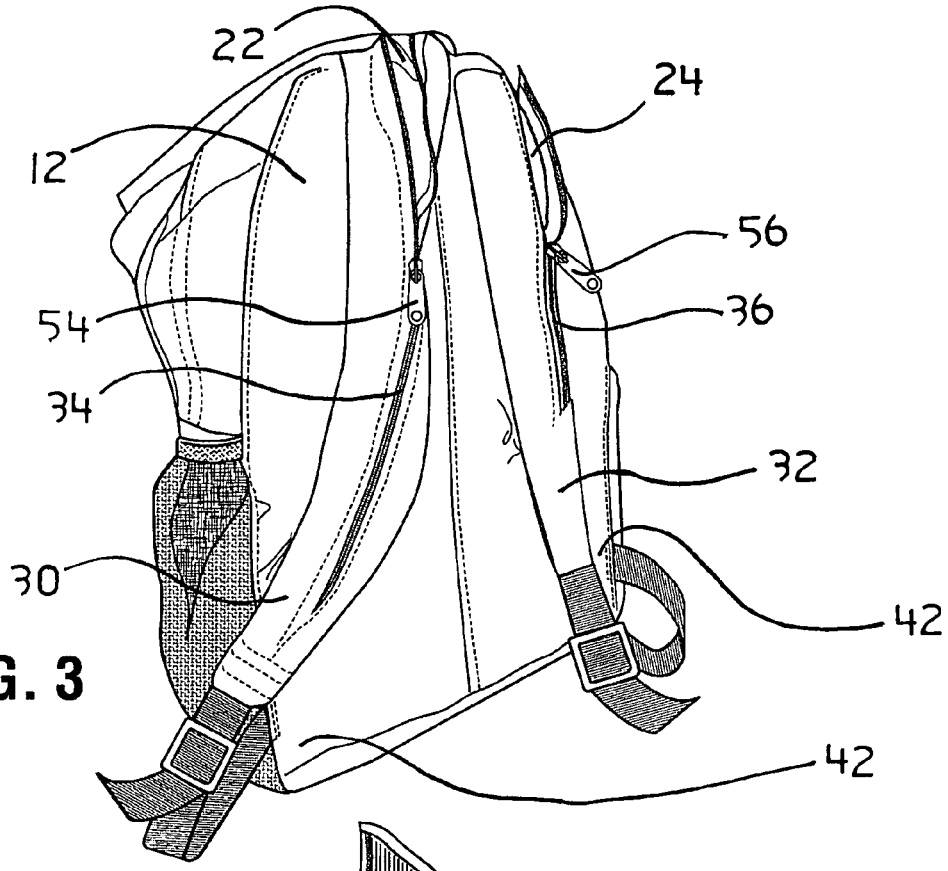
FIG. 3 is a perspective side view of the back pack with a hood compartment partially opened and the hood halves stored within the compartments.
Figure 4:
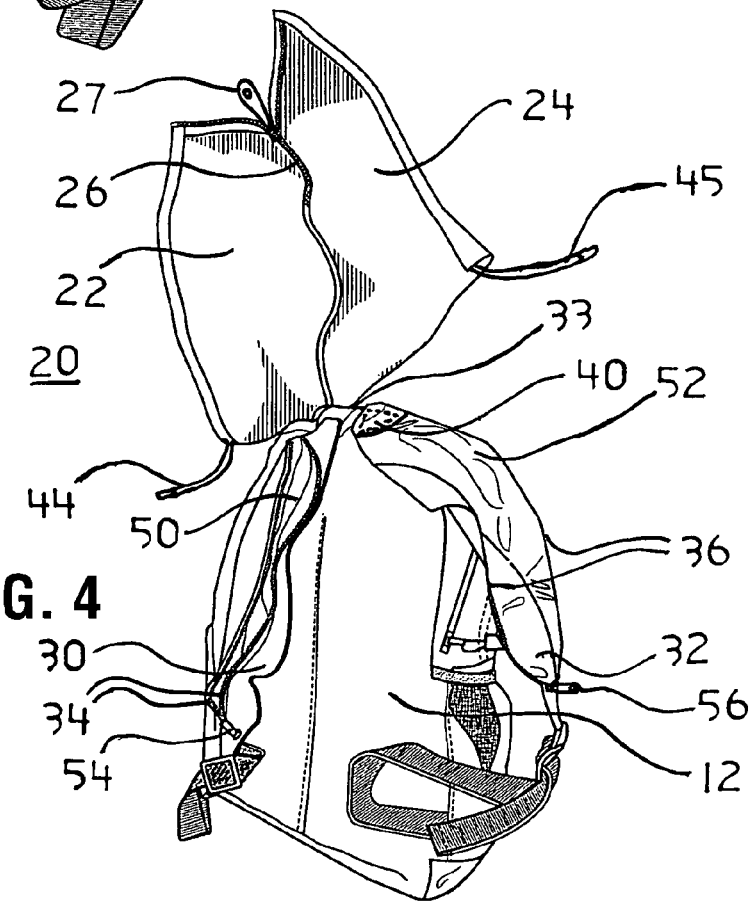
FIG. 4 is a perspective front view of the backpack with the hood partially assembled.

In accordance with the present invention, there is provided a backpack 10 composed of natural or synthetic fabric, plastic, or leather or combinations thereof including a two piece hood 20 attached to the top of the backpack which can each be stored within compartments contained within the back straps of the backpack. FIG. 1 shows the backpack 10 including a main storage compartment 14. In FIGS. 3 and 4, back straps 30 and 32 are attached to the upper and lower marginal edges of the front side 12 of backpack 10. As shown in FIG. 1, the proximate ends of the hood 20 are attached at the center of the upper marginal edge 33 of the front side 12 of backpack 10 disposed in between the straps and generally in alignment with the top attachment point of the backpack strap and is shown assembled and ready to use.

Figure 2:
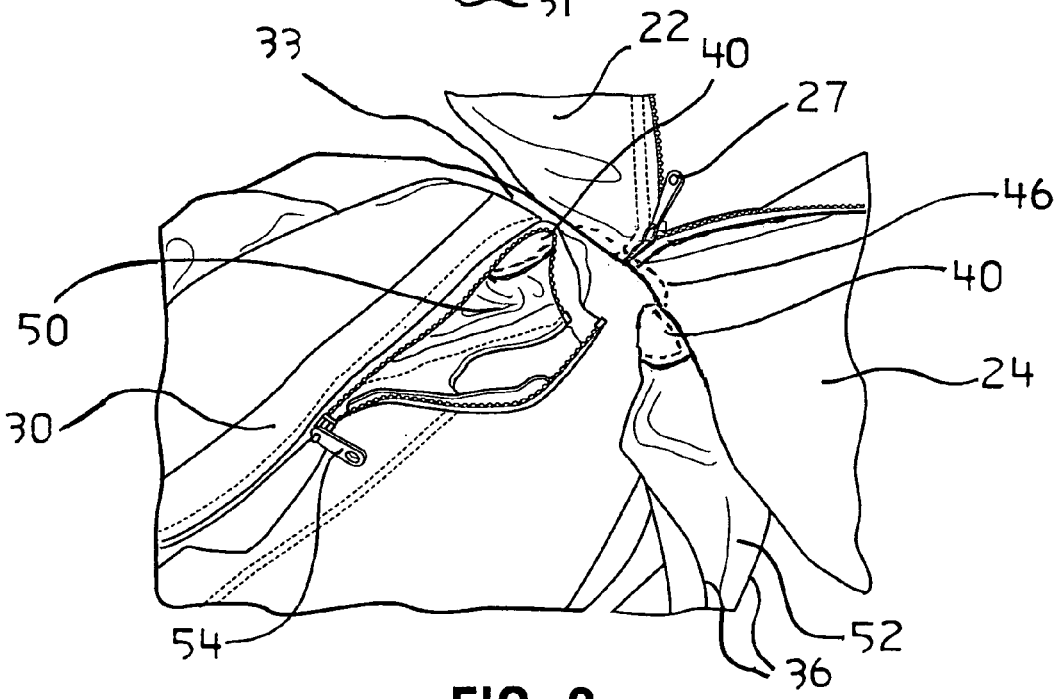
FIG. 2 is a perspective front view of the side of the backpack showing a partially opened hood compartment.

As shown in FIG. 4, a preferred embodiment reinforcing panel 40 comprised of leather or synthetic material is attached by stitching to the upper end of the inside of compartment 52 of back strap 32. Of course, the reinforcement panel is optional and the hood can be attached directly to the exterior of the panel or material comprising the backpack body. Then, as a unit, leather panel 40 and the upper marginal edge of back strap 32 are stitched to the right of center of upper marginal edge 33 of the front side 12 of backpack 10. The upper end of back strap 30 also includes a reinforcing panel 40 which is shown in FIG. 2, and is attached just to the left of the center of the upper marginal edge 33 of the front side 12 of backpack 10. The lower free ends of back straps 30 and 32 include adjustable strap portions which are attached near the lower corners 42 of the front side 12 of backpack 10, as shown in FIG. 3.

As shown in FIGS. 2 and 4, each of back straps 30 and 32 includes a closure means located on the inside surface of the straps adjacent the user. As shown in the preferred embodiment, a pair of corresponding lockable strips comprising a zipper are attached to each side of the longitudinal openings of slits formed in the surface of the backpack straps which are tubular or hollow in design and more particularly are formed from a single piece of material or fabric sewn together along a longitudinal seam providing a flattened profile depicting a hollow strap. Of course, it is contemplated that hook and loop fastener strips such as sold under the trade name VELCRO could be used instead of zippers or in combination therewith. Moreover, snaps, buttons and button holes or loops could be utilized as strap closure means as well. In addition, the slits or longitudinal openings formed in the backpack straps could be lined with elastic or utilize a tongue and groove closure means such as interlocking plastic ridges. Finally, overlapping flaps on the underside portion of the backpack straps could provide sufficient retaining means to provide closure.

It is also contemplated that at least one additional strip of material comprising a longitudinal tubular member could be removably affixed to a conventional backpack strap comprised of a single strip of material in order to provide a longitudinal storage compartment or pocket for storage of a two piece of split hood as described to be used in combination therewith. Moreover, the removable straps could include a split hood containable therein which could be linked together to form an integral hood and that the hood need only be connected at its proximate end to an upper end of the strap.

As illustrated in FIG. 4, interlocking zipper strips 34 and 36 are shown opened with zipper pulls 54 and 56, respectively, at the bottom of the zippers 34 and 36. In FIG. 4, the zippers are shown in an open unzipped state, and longitudinal compartments 50 and 52 are shown with the flaps spread apart in an open position. FIG. 4 also shows corresponding longitudinal hood halves 22 and 24 cooperatively engaged and zipped together to form an integral one piece hood. Also shown in FIG. 4, hood halves 22 and 24 each include a pull string or tie 44 and 45 at their respective lower free corners, for the purpose of tying hood 20 tightly under a user's chin. Of course, it is contemplated that hook and loop fastener strips such as sold under the trade name VELCRO could be used instead of zippers or in combination therewith. Moreover, snaps, buttons and button holes or loops could be utilized as strap closure means as well. In addition, the slits or longitudinal openings formed in the backpack straps could be lined with elastic or utilize a tongue and groove closure means such as interlocking plastic ridges. Finally, overlapping flaps on the underside portion of the backpack straps could provide sufficient retaining means to provide closure.

As shown in FIG. 3, hood halves 22 and 24 are almost totally concealed within the zippered compartments of back straps 30 and 32, respectively. A small portion of hood halves 22 and 24 is exposed even when the zippers 34 and 36 are completely zipped, due to the fact that hood halves 22 and 24 and the lower marginal edge of zipper 26 are attached at a position outside of compartments 50 and 52 at a position at the center of upper marginal edge 33 of backpack 10 with stitching 46 shown in FIG. 2.

FIG. 2 shows a partial view of hood halves 22 and 24 with zipper pull 27 unzipped and with hood halves 22 and 24 almost completely apart from one another. It is anticipated that a user would zip compartments 50 and 52 closed anytime the backpack is being worn. When a user must quickly prepare the hood for wear, the backpack is removed. The back straps will be easily accessible so that the user can quickly unzip the back strap compartments zip the hood together, zip the back strap compartments closed, put on the backpack and hood and proceed.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A backpack consisting of:

a backpack body comprising a front side and a back side connecting to a right side and a left side connecting to a bottom panel, and a top panel including an opening therein connecting to said front side, said back side, said right side and side left side, and a left backpack strap and a right backpack strap extending from said back side of said backpack;

said left backpack strap and said right backpack strap including at least a portion thereof comprising a longitudinal strip of tubular material defining hollow strap having a front side and a back side adapted to be adjacent a user;

said left backpack strap and said right backpack strap each one containing a longitudinal opening and resealable means for closure selected from the group consisting of a zipper, hook and loop fasteners, buttons and button holes, snaps, tongue and groove fastener, and overlapping flaps, said resealable means for closure extending along a selected length of said hollow strap defining a longitudinal storage pocket disposed within said left backpack strap and said right backpack strap, said longitudinal storage pocket extending from an upper end of said left backpack strap and said right backpack strap a selected distance downward therefrom;

said left backpack strap and said right backpack strap having an upper free end attaching to an upper marginal edge of said backpack and a lower free end attaching to a lower edge of said backpack;

a hood comprising a left hood portion and a right hood portion releasably joined together by a means for closing extending from a front end to a rear end of said hood, said hood having a proximal bottom end attaching to an upper end of said back side of said backpack;

wherein disengaging said left hood portion from said right hood portion of said hood forms a pair of disconnected split hood portions, each one disposable in said corresponding longitudinal storage pocket of said left backpack strap and said right backpack strap for storage;

where upon opening of said storage pocket of said left backpack strap and said right backpack strap, said left hood portion and said right hood portion are removable therefrom and releasably joined together forming a hood for covering the head of the user, and a major portion of said longitudinal storage pocket is closeable and functionable as a backpack strap.

2. A backpack consisting of:

a backpack body comprising a front side and a back side connecting to a right side and a left side connecting to a bottom panel, and a top portion of said front side including an opening therein connecting to said front side, said back side, said right side and side left side, and a left backpack strap and a right backpack strap extending from said back side of said backpack;

said left backpack strap and said right backpack strap including at least a portion thereof comprising a longitudinal strip of tubular material defining hollow strap having a front side and a back side adapted to be adjacent a user;

said left backpack strap and said right backpack strap each one containing a longitudinal opening and resealable means for closure selected from the group consisting of a zipper, hook and loop fasteners, buttons and button holes, snaps, tongue and groove fastener, and overlapping flaps, said resealable means for closure extending along a selected length of said hollow strap defining a longitudinal storage pocket disposed within said left backpack strap and said right backpack strap, said longitudinal storage pocket extending from an upper end of said left backpack strap and said right backpack strap a selected distance downward therefrom;

said left backpack strap and said right backpack strap having an upper free end attaching to an upper marginal edge of said backpack and a lower free end attaching to a lower edge of said backpack;

a hood comprising a left hood portion and a right hood portion releasably joined together by a means for closing extending from a front end to a rear end of said hood, said hood having a proximal bottom end attaching to an upper end of said back side of said backpack;

wherein disengaging said left hood portion from said right hood portion of said hood forms a pair of disconnected split hood portions, each one disposable in said corresponding longitudinal storage pocket of said left backpack strap and said right backpack strap for storage;

where upon opening of said storage pocket of said left backpack strap and said right backpack strap, said left hood portion and said right hood portion are removable therefrom and releasably joined together forming a hood for covering the head of the user, and a major portion of said longitudinal storage pocket is closeable and functionable as a backpack strap.

3. A backpack, consisting of:

a backpack body having a front side, a back side, a right side, a left side, a top, a bottom, a left backpack strap, a right backpack strap;

said left backpack strap having the upper free end thereof rigidly attached at a position just to the left of the center of an upper marginal edge of the front side of said backpack, said right backpack strap having an upper free end thereof rigidly attached at a position just to the right of the center of an upper marginal edge of the front side of said backpack, said left backpack strap having a lower free end thereof rigidly attached to a lower left marginal edge of the front side of said backpack, and said right backpack strap having a lower free end thereof rigidly attached to a lower right marginal edge of the front side of said backpack;

a hood comprising a left hood half, a right hood half and a hood zipper joining said left hood half and said right hood half, said left hood half having a right marginal edge and a top marginal edge thereof sewn to a left side of said hood zipper, said right hood half having a left marginal edge and a top marginal edge thereof sewn to a right side of said hood zipper, a lower marginal edge of said hood zipper being attached to said center of said upper marginal edge of said front side of said backpack and adjacent to said upper ends of said left backpack strap and said right backpack straps, said hood zipper being capable of releasably holding said left hood half and said right hood half together to form a hood configured to be worn on a user's head; and at least a portion of said left back strap and said right back strap comprising tubular material defining a longitudinal hood storage pocket extending from said upper end, said hood storage pocket including a pocket zipper along the length thereof, said hood storage pocket containing a free portion of said left hood half or said right hood half respectively in a stored position:

where upon unzipping said pocket zipper of said hood storage pocket of said left back strap and said right back strap, said left hood half and said right hood strap are removable therefrom and zipped together forming a hood for covering the head of the user, and a major portion of said longitudinal storage pocket is closeable and functionable as a backpack strap.

* * * * *